US007616919B2

(12) United States Patent
Aratachi et al.

(10) Patent No.: US 7,616,919 B2
(45) Date of Patent: Nov. 10, 2009

(54) IMAGE FORMING APPARATUS AND FIXING DEVICE

(75) Inventors: Tomitake Aratachi, Nagoya (JP); Masahito Kajita, Kasugai (JP); Makoto Hasegawa, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 285 days.

(21) Appl. No.: 11/349,978

(22) Filed: Feb. 9, 2006

(65) Prior Publication Data

US 2006/0177249 A1 Aug. 10, 2006

(30) Foreign Application Priority Data

Feb. 10, 2005 (JP) ..... 2005-034319

(51) Int. Cl.
*G03G 15/14* (2006.01)

(52) U.S. Cl. ..... 399/323

(58) Field of Classification Search ..... 347/2, 347/44; 399/323, 406; 271/209, 311, 900
See application file for complete search history.

(56) References Cited

U.S. PATENT DOCUMENTS 5,517,292 A 5/1996 Yajima et al.
5,867,181 A * 2/1999 Nakane et al. ..... 347/2
6,305,682 B1 * 10/2001 Saito et al. ..... 271/10.11
6,658,229 B2 * 12/2003 Ando et al. ..... 399/323
6,671,490 B2 * 12/2003 Suenaga ..... 399/406

FOREIGN PATENT DOCUMENTS

| | | |
|---|---|---|
| JP | A-04-322283 | 11/1992 |
| JP | A-05-210328 | 8/1993 |
| JP | A-07-049633 | 2/1995 |
| JP | A-2001-235958 | 8/2001 |
| JP | A 2003-156967 | 5/2003 |

* cited by examiner

*Primary Examiner*—Stephen D Meier
*Assistant Examiner*—Alexander C. Witkowski
(74) *Attorney, Agent, or Firm*—Oliff & Berridge, PLC

(57) ABSTRACT

An image forming apparatus includes: a fixing device having a heating member and a pressing member which is pressed against the heating member, the heating member and the pressing member holding and transporting a recording medium to thermally fix a developer on the recording medium; a peeling member that peels the recording medium off the heating member, the peeling member being disposed downstream, in a transport direction of the recording medium, of a holding position where the heating member and the pressing member hold the recording medium; and an interference prevention member that prevents the recording medium from interfering with the peeling member after being peeled off the heating member by the peeling member.

14 Claims, 8 Drawing Sheets

IMAGE FORMING APPARATUS AND FIXING DEVICE

CROSS REFERENCE TO RELATED APPLICATION

The present disclosure relates to the subject matter contained in Japanese Patent Application No. 2005-034319 filed Feb. 10, 2005, which is incorporated herein by reference in its entirety.

TECHNICAL FIELD

One aspect of the invention relates to an image forming apparatus and a fixing device.

BACKGROUND

Fixing units which are equipped with a heating roller as a heating member and a pressing roller as a pressing member which is pressed against the heating roller are provided conventionally as units used in image forming apparatus such as laser printers. In fixing units of this kind, thermal fixing is performed in such a manner that a sheet (recording subject medium) to which a toner image has been transferred is held between and transported by the two rollers. Further, in fixing units of this kind, to enable smooth transport of a sheet that has been subjected to fixing, a peeling nail for peeling the sheet off the heating roller is disposed downstream of the holding position in the sheet transport direction of the fixing unit.

Incidentally, in the above-described conventional image forming apparatus, if the distance between the peeling nail and the holding position (what is called a nip position) where a sheet is held between the heating roller and the pressing roller is large, a problem arises that a sheet that has been subjected to fixing behaves differently depending on its state (i.e., its behavior tends to be unstable) as exemplified by the sheet's being peeled off immediately after passing the nip position without being peeled off by the peeling nail and the sheet's being transported to the position of the peeling nail and peeled off forcibly by it. If the sheet behavior is so unstable, trouble (e.g., sheet waving) due to deviation from an assumed sheet transport path tends to occur and nay prevent smooth and highly accurate image formation. To make such trouble less likely, it is desirable to dispose the peeling nail closer to the nip position so that a sheet is not peeled off at a position that is unduly away from the nip position (in other words, it is desirable to peel off a sheet stably near the nip position). However, an attempt to dispose the peeling nail closer to the nip position so that a sheet is peeled off stably near the nip position makes part of the peeling nail prone to interfere with a sheet being transported, resulting in a problem that it prevents good image formation.

The invention has been made in view of the above circumstances, and provides, in a device which performs thermal fixing by means of a heating member and a pressing member, a configuration capable of satisfactorily peeling off a recording medium that has been subjected to fixing while effectively preventing interference between a peeling member and a recording subject medium.

SUMMARY

One aspect of the invention may provide an image forming apparatus including: a fixing device having a heating member and a pressing member which is pressed against the heating member, the heating member and the pressing member holding and transporting a recording medium to thermally fix a developer on the recording medium; a peeling member that peels the recording medium off the heating member, the peeling member being disposed downstream, in a transport direction of the recording medium, of a holding position where the heating member and the pressing member hold the recording medium; and an interference prevention member that prevents the recording medium from interfering with the peeling member after being peeled off the heating member by the peeling member.

Another aspect of the invention may provide a fixing device, including; a heating member; a pressing member which is pressed against the heating member to hold and transport a recording medium therebetween to thermally fix a developer on the recording medium; a peeling member disposed downstream, in a transport direction of the recording medium, of a holding position where the heating member and the pressing member hold the recording medium; and an interference prevention member that prevents the recording medium from interfering with the peeling member.

BRIEF DESCRIPTION OF THE DRAWINGS

One aspect of the invention may be more readily described with reference to the accompanying drawings.

DETAILED DESCRIPTION

<Illustrative Aspect 1>

A first illustrative aspect of the present invention will be described below.

1. Total Configuration

Figure 1:
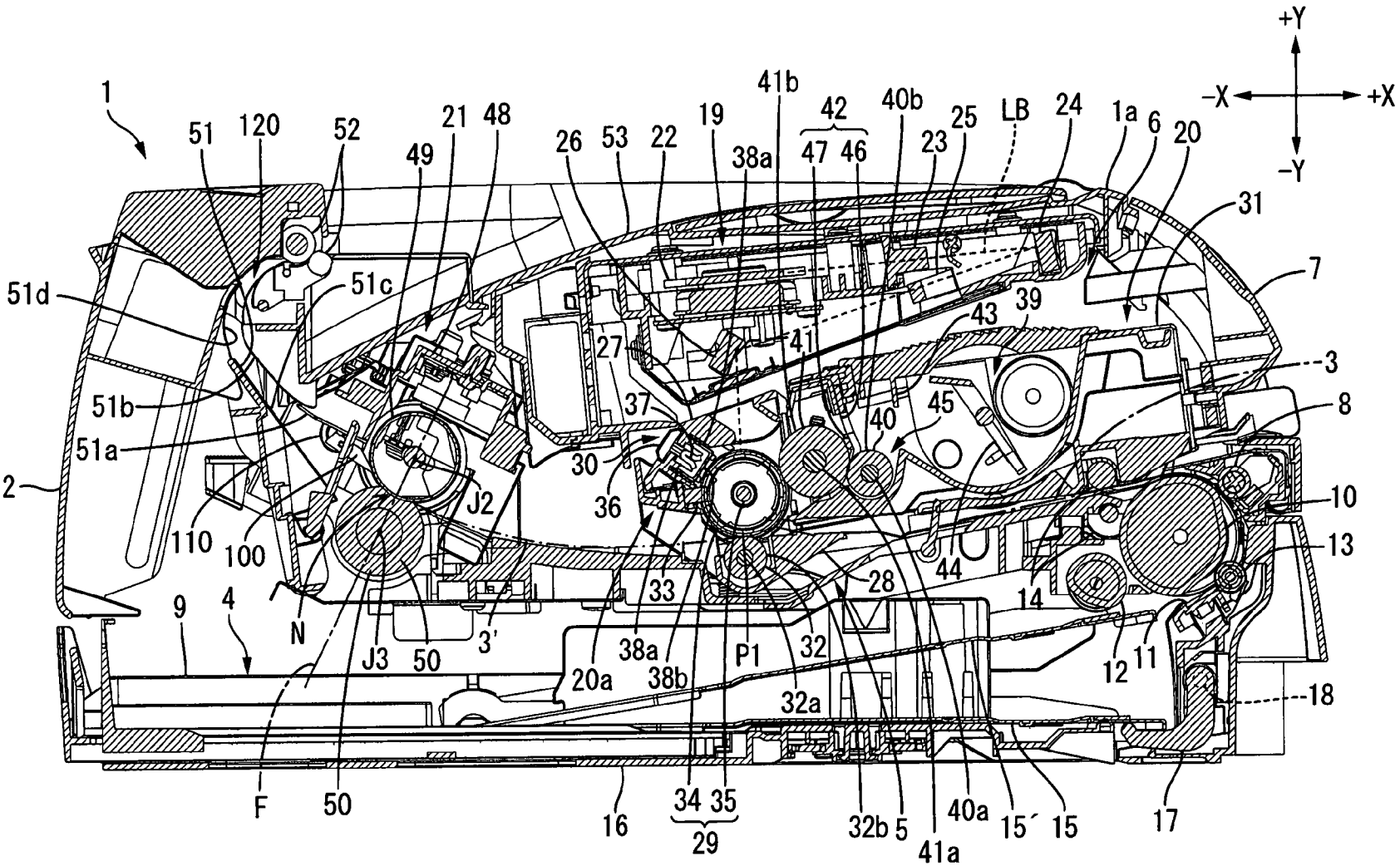
FIG. 1 is a side/sectional view of an important part of a laser printer as an image forming apparatus according to a first aspect of the invention.

First, the total configuration of a laser printer according to this illustrative aspect will be described with reference to FIG. 1. FIG. 1 is a side/sectional view of an important part of the laser printer as an image forming apparatus according to the illustrative aspect of the invention.

The laser printer 1 is equipped with a main body casing 2, a feeder unit 4 for supplying a sheet 3 as a recording subject medium, an image forming unit 5 for forming an image on the sheet 3 supplied, and other units and components. The feeder unit 4, the image forming unit 5, etc. are housed in the main body casing 2. In this illustrative aspect, a sheet is denoted by reference symbol 3 and a sheet transport path is denoted by reference symbol 3' conceptually.

One side wall of the main body casing 2 is formed with an attachment/detachment opening 6 for attachment and detachment of a process cartridge 20 (described later) as well as a front cover 7 for opening and closing the attachment/detachment opening 6. The front cover 7 is rotatably supported by a cover shaft (not shown) that is inserted in a bottom end portion of the front cover 7. With this structure, if the front cover 7 is closed by rotating it about the cover shaft, the attachment/detachment opening 6 is closed by the front cover 7 as shown in FIG. 1. It the front cover 7 is opened (inclined) with the cover shaft serving as a supporting point, the attachment/detachment opening 6 is opened, whereby the process cartridge 20 can be attached to or detached from the main body casing 2 through the attachment/detachment opening 6. In the laser printer 1, a main body part other than the process cartridge 20 is an apparatus main body 1*a*. In this illustrative aspect, the process cartridge 20 having various components such as a photoreceptor body 29 can be attached to and detached from the apparatus main body 1*a*.

In this illustrative aspect, the side where the front cover 7 is provided will be called "front side" and the side opposite to it will be called "rear side" (see FIG. 1). In the following description, the front-rear direction of the laser printer 1 will be called "X-axis direction," the height direction of the laser printer 1 will be called "Y-axis direction," and the width direction of a sheet being transported will be called "Z-axis direction" (the Z-axis direction is not shown in FIG. 1).

The feeder unit 4 is equipped with a sheet supply tray 9 that is attached to a bottom portion of the main body casing 2 detachably, a sheet feed roller 10 and a separation pad 11 that are disposed above a front end portion of the sheet supply tray 9, a pickup roller 12 which is disposed behind the sheet feed roller 10, a pinch roller 13 which is disposed at a bottom-front position with respect to the sheet feed roller 10 so as to be opposed to it, a paper powder removal roller 8 which is disposed at a top-front position with respect to the sheet feed roller 10 so as to be opposed to it, and registration rollers 14 which are disposed at a top-rear position with respect to the sheet feed roller 10.

A sheet pressing plate 15 on which sheets 3 can be stacked is provided inside the sheet supply tray 9. Supported swingably at its rear end portion, the sheet pressing plate 15 can be swung between a placement position where its front end portion is located below and it extends parallel with a bottom plate 16 of the sheet supply tray 9 and a transport position where its front end portion is located above and it is inclined.

A lever 17 for lifting up the front end portion of the sheet pressing plate 15 is disposed in a front end portion of the sheet supply tray 9. The lever 17 has a generally L-shaped cross section and extends from in front of the sheet pressing plate 15 to below it. A top end portion of the lever 17 is attached to a lever shaft 18 which is disposed in the front end portion of the sheet supply tray 9 and a rear end portion of the lever 17 is in contact with the bottom surface of the front end portion of the sheet pressing plate 15. With this structure, when clockwise (as viewed in the figure) rotational drive force is applied to the lever shaft 18, the lever 17 is rotated with the lever shaft 18 as a supporting point. The rear end portion of the lever 17 lifts up the front end portion of the sheet pressing plate 15, whereby the sheet pressing plate 15 is moved to the transport position. Reference symbol 15' denotes the sheet pressing plate in a lifted-up state.

When the sheet pressing plate 15 is moved to the transport position, the sheets 3 on the sheet pressing plate 15 are pressed against the pickup roller 12 and sheets start to be transported toward the boundary between the sheet feed roller 10 and the separation pad 11 by rotation of the pickup roller 12.

On the other hand, if the sheet supply tray 9 is detached from the main body casing 2, the front end portion of the sheet pressing plate 15 lowers due to its own weight and the sheet pressing plate 15 is moved to the placement position. In a state that the sheet pressing plate 15 is located at the placement position, sheets 3 can be stacked on the sheet pressing plate 15.

The sheets 3 that have been sent out toward the boundary between the sheet feed roller 10 and the separation pad 11 by the pickup roller 12 are held between the sheet feed roller 10 and the separation pad 11. As the sheet feed roller 10 is rotated, the sheets 3 are separated into single sheets reliably and fed one by one. A sheet 3 thus fed passes between the sheet feed roller 10 and the pinch roller 13, and is transported to the registration rollers 14 after paper powder is removed from it by the paper powder removal roller 8.

Being a pair of rollers, the registration rollers 14 register the sheet 3 and then transport the sheet 3 to a transfer position P1 between a photoreceptor body 29 and a transfer roller 32 (both described later) where a toner image is transferred from the photoreceptor body 29 to the sheet 3 (the toner corresponds to the term "developer" as used in the claims).

The image forming unit 5 is equipped with a scanner unit 19, the process cartridge 20, a fuser 21, etc.

The scanner unit 19 occupies a top portion of the main body casing 2, and is equipped with a laser light source (not shown), a polygon mirror 22 which is driven rotationally, an fθ lens 23, a reflector 24, a lens 25, a reflector 26, etc. As indicated by a broken line LB, a laser beam emitted from the laser light source according to image data is deflected by the polygon mirror 22, passes through the fθ lens 23, is path-folded by the reflector 24, passes through the lens 25, is path-bent downward by the reflector 26, and is finally applied to the surface of a drum main body 34 of the photoreceptor body 29 (described later) of the process cartridge 20.

The process cartridge 20 is attached to the main body casing 2 detachably so as to be disposed under the scanner unit 19. A drum cartridge 20*a* of the process cartridge 20 is provided with a top frame 27 and a bottom frame 28 that is separate from and is combined with the top frame 27. The process cartridge 20 is equipped with, in the drum cartridge 20*a*, the photoreceptor body 29 as an image carrying body, a scorotron charger 30 (hereinafter also referred to simply as "charger 30") as a charging means, a development cartridge 31, the transfer roller 32 as a transfer means, and a cleaning brush 33.

The photoreceptor body 29 is equipped with the drum main body 34 which is cylindrical and whose outermost layer is a positively chargeable photoreceptor layer made of polycarbonate or the like and a metal drum shaft 35 which extends in the longitudinal direction of the drum main body 34 along the axis of the drum main body 34. The drum shaft 35 is supported by the top frame 27 and the drum main body 34 is rotatably supported by the drum shaft 35. In this manner, the photoreceptor body 29 is provided in the top frame 27 so as to be rotatable about the drum shaft 35.

As shown in FIG. 1, the scorotron charger 30 is supported by the top frame 27 and is disposed at a top-rear position with respect to the photoreceptor body 29 so as to be opposed to the photoreceptor body 29 with a prescribed interval (contact with the photoreceptor body 29 is avoided). The scorotron charger 30 is equipped with a discharge wire 37, two opposed electrodes 38*a* which extend in the axial direction of the photoreceptor body 29 and are opposed to each other with a prescribed interval, and a grid electrode 38*b* which is disposed between the discharge wire 37 and the photoreceptor body 29 and serves to control the amount of discharge from the discharge wire 37 to the photoreceptor body 29. In the scorotron charger 30, a bias voltage is applied to the opposed electrodes 38*a* and the grid electrode 38*b* and a high voltage is applied to the discharge wire 37, whereby corona discharge occurs from the discharge wire 37. In this manner, the surface of the photoreceptor body 29 can be charged positively and uniformly.

A wiper 36 for cleaning the discharge wire 37 is provided in the scorotron charger 30 so as to hold the discharge wire 37 from both sides.

As shown in FIG. 1, the development cartridge 31 has a box shape that is open on the rear side, and is attached to the bottom frame 28 detachably. As shown in FIG. 1, a toner accommodation room 39, a supply roller 40, a development roller 41, and a layer thickness limiting blade 42 are provided in the development cartridge 31.

The toner accommodation room 39 is a front internal space of the development cartridge 31 which is divided by a partition plate 43. A developer that is a positively chargeable, non-magnetic one-component toner is charged in the toner accommodation room 39. The toner is a polymeric toner obtained by copolymerizing, by, for example, suspension polymerization, polymerizable monomers that are, for example, a styrene monomer such as styrene and an acrylic monomer such as acrylic acid, alkyl ($C_1$-$C_4$) acrylate, or alkyl ($C_1$-$C_4$) methacrylate. Such a polymeric toner consists of generally spherical particles and is very high in flowability, and hence enables high-quality image formation.

The toner contains a colorant such as carbon black and wax, and an additive such as silica is added to increase the flowability. The average particle diameter of the toner is about 6 to 10 μm An agitator 44 is provided in the toner accommodation room 39. The toner in the toner accommodation room 39 is agitated by the agitator 44, and toner is discharged toward the supply roller 40 through an opening 45 that is formed under the partition plate 45 and allows passage in the front-rear direction. The supply roller 40 is disposed behind the opening 45 and supported rotatably by the development cartridge 31. The supply roller 40 is configured in such a manner that a metal roller shaft 40*a* is covered with a roller 40*b* made of a conductive foamed material. The supply roller 40 is driven rotationally by motive power supplied from a motor (not shown).

The development roller 41 is disposed behind the supply roller 40, and is supported rotatably by the development cartridge 31 in such a manner that the development roller 41 and the supply roller 40 are in contact with each other and compress each other. The development roller 41 is opposed to and is in contact with the photoreceptor body 29 in a state that the development cartridge 31 is attached to the bottom frame 28. The development roller 41 is configured in such a manner that a metal roller shaft 41*a* is covered with a roller 41*b* made of a conductive rubber material. In a rear end portion of the development cartridge 31, both end portions of the roller shaft 41*a* project outward from the side surfaces of the development cartridge 31 in the width direction that is perpendicular to the front-rear direction (see FIGS. 3 and 4). The roller 41*b* of the development roller 41 is configured in such a manner that the surface of a roller main body made of conductive urethane rubber or silicone rubber containing carbon fine particles etc. is covered with a coat layer made of urethane rubber or silicone rubber containing fluorine. During development, a development bias is applied to the development roller 41. The development roller 41 is driven rotationally in the same direction as the supply roller 40 by motive power supplied from a motor (not shown).

As shown in FIG. 1, the layer thickness limiting blade 42 is configured in such a manner that a pressing portion 47 that is made of insulative silicone rubber and has a semicircular cross section is provided on a tip portion of a blade main body 46 which is a metal leaf spring member. The layer thickness limiting blade 42 is supported by the development cartridge 31 at a position above the development roller 41, and the pressing portion 47 is brought in pressure contact with the development roller 41 by the elastic force of the blade main body 46.

Toner that is discharged through the opening 45 is supplied to the development roller 41 by rotation of the supply roller 40. During that course, the toner is charged positively by friction between the supply roller 40 and the development roller 41. The toner that has been supplied onto the development roller 41 goes into the boundary between the pressing portion 47 of the layer thickness limiting blade 42 and the development roller 41 and is further charged there as the development roller 41 is rotated. As a result, the toner comes to be carried by the development roller 41 as a thin layer having a constant thickness.

The transfer roller 32 is configured so as to transfer a toner image carried by the photoreceptor body 29 to a sheet 3. The transfer roller 32 is supported rotatably by the bottom frame 28, and is disposed so as to be opposed to the photoreceptor body 29 in the vertical direction and be in contact with the latter so as to form a nip position in a state that the top frame 27 and the bottom frame 28. are combined together. The transfer roller 32 is configured in such a manner that a metal roller shaft 32*a* is covered with a roller 32*b* made of a conductive rubber material. During a transfer, a negative transfer bias (i.e., opposite in polarity to the transfer bias that is applied to the charger 30) is applied to the transfer roller 32. The transfer roller 32 is driven rotationally in the direction opposite to the rotation direction of the photoreceptor body 29 by motive power supplied from a motor (not shown).

The cleaning brush 33 is attached to the bottom frame 28, and is disposed behind the photoreceptor body 29 so as to be opposed to and be in contact with the photoreceptor body 29 in a state that the top frame 27 and the bottom frame 28 are combined together.

As the photoreceptor body 29 is rotated, its surface is charged positively and uniformly by the scorotron charger 30 and is then scanned at high speed with (i.e., exposed to) a laser beam coming from the scanner unit 19, whereby an electrostatic latent image corresponding to an image to be formed on a sheet 3 is formed thereon.

Then, as the development roller 41 is rotated, toner that is carried by the development roller 41 and charged positively is supplied to the exposed portions (where the potential has been lowered by the exposure to the laser beam) of the surface of the photoreceptor body 29 that was charged positively and uniformly. As a result, the electrostatic latent image on the photoreceptor body 29 is visualized and a toner image is formed on the surface of the photoreceptor body 29 by inverted development.

Then, as shown in FIG. 1, the toner image formed on the surface of the photoreceptor body 29 is transferred to a sheet 3 because of the presence of the transfer bias applied to the transfer roller 32 when the sheet 3 that has been transported by the registration rollers 14 passes the transfer position P1 between the photoreceptor body 29 and the transfer roller 32. The sheet 3 to which the toner image has been transferred is transported to the fuser 21.

Transfer residual toner that remains on the photoreceptor body 29 after the transfer is collected by the development roller 41. Paper powder that has come from the sheet 3 and is stuck to the photoreceptor body 29 after the transfer is collected by the cleaning brush 33.

The fuser 21, which corresponds to the term "fixing means" in the claims, is to fix, on a sheet (recording subject medium) 3, a toner image (developer image) that has been transferred to the sheet 3 by the transfer roller 32. The fuser 21 is disposed behind the process cartridge 20, and is equipped with a fuser frame 48, a heating roller 49, and a pressing roller 50. The heating roller 49 and the pressing roller 50 are provided in the fuser frame 48. The fuser 21 thermally fixes toner that has been transferred to a sheet 3 at the transfer position P1 while the sheet 3 passes between the heating roller 49 and the pressing roller 50. The details of the fuser 21 will be described later.

A toner-fixed sheet 3 is transported to sheet ejection guide members 51 which extend in the vertical direction toward the top surface of the main body casing 2. The sheet 3 that has been transported to the sheet ejection guide members 51 is ejected onto a sheet ejection tray 53 which is part of the top surface of the main body casing 2 by a pair of ejection rollers 52 which are disposed above the sheet ejection guide members 51.

2. Specific Configuration of Fuser

Figure 2:
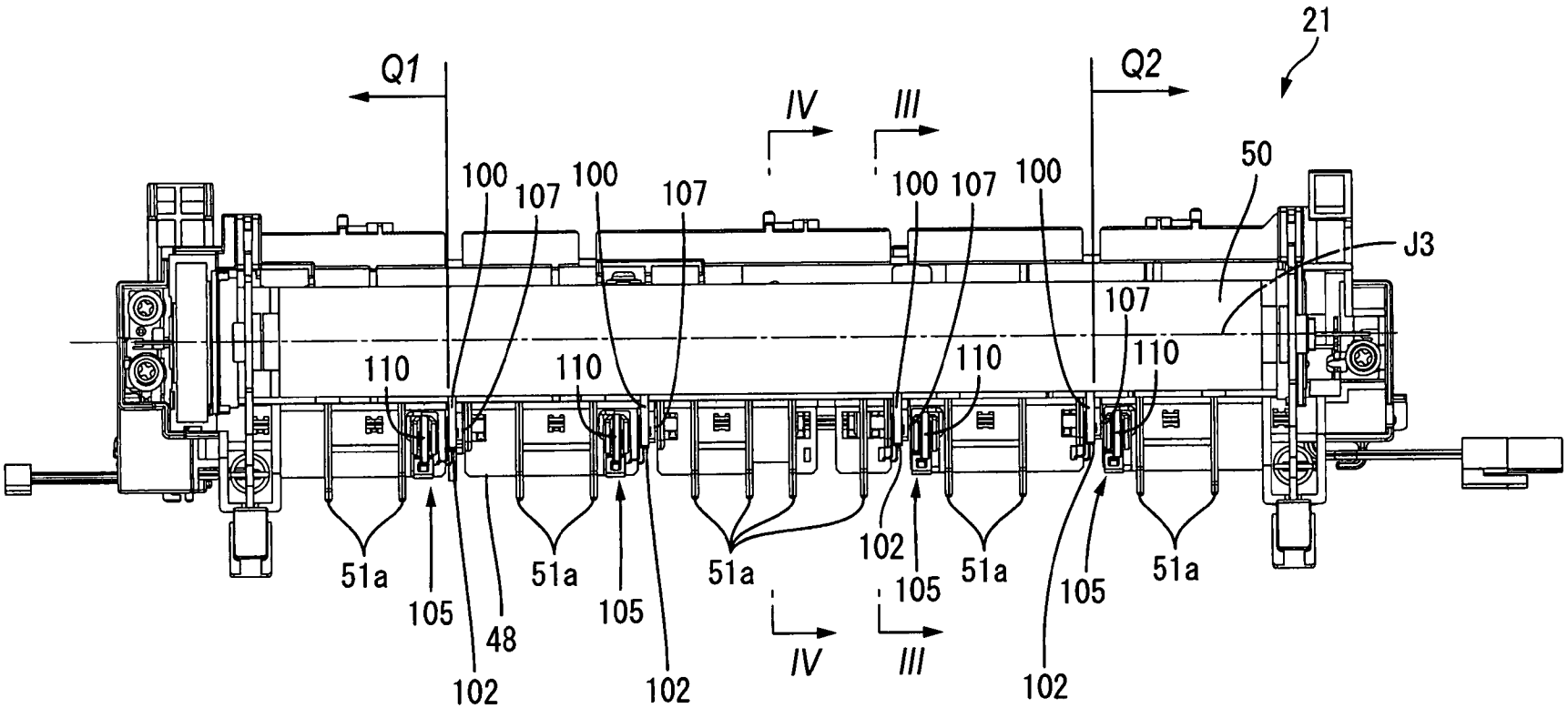
FIG. 2 is a view of an important part of a fuser according to the first aspect as viewed from below in a direction in which a heating roller and a pressing roller are opposed to each other.
Figure 3:
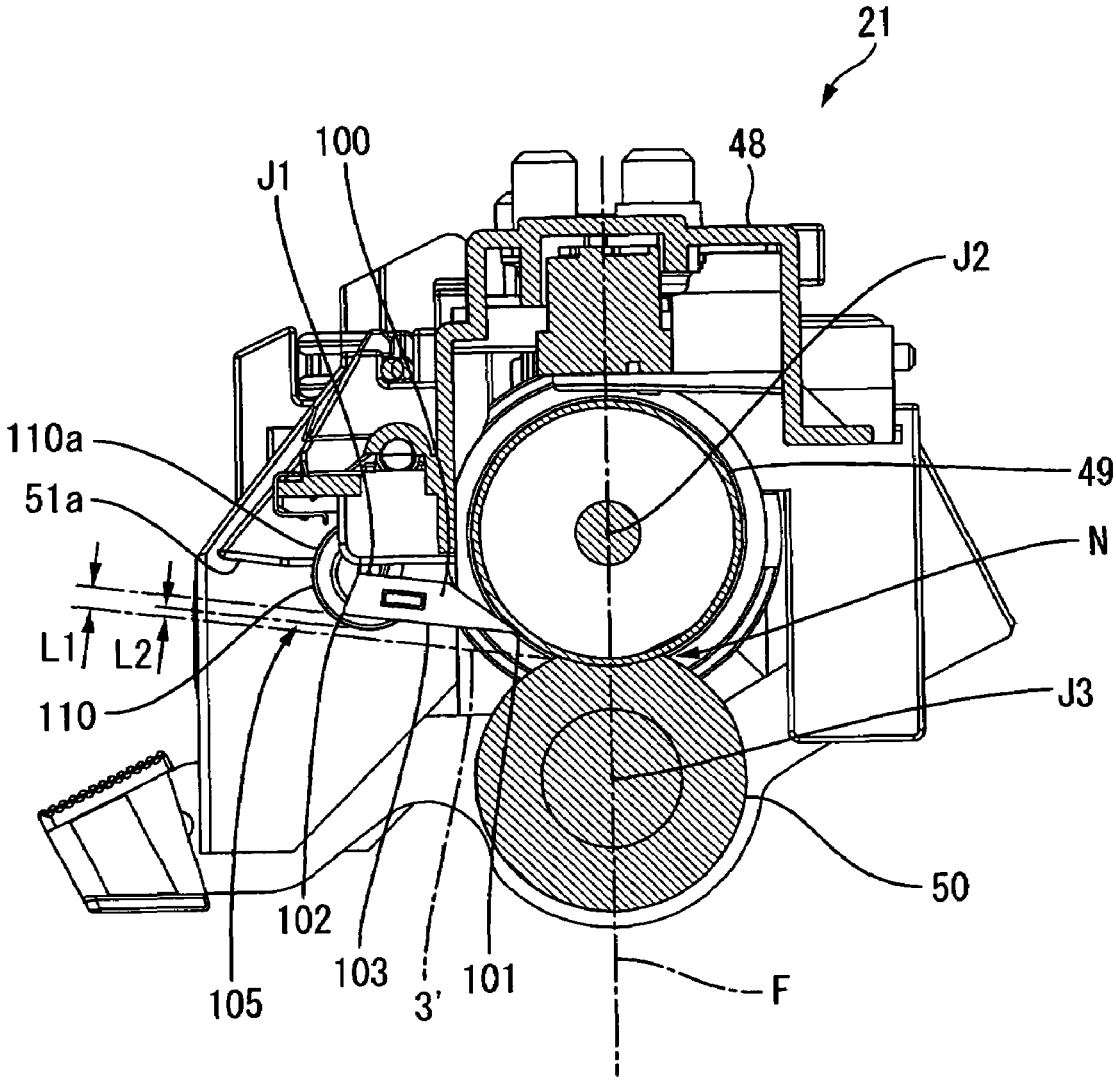
FIG. 3 is a conceptual sectional view taken along line 3-3 in FIG. 2.
Figure 4:
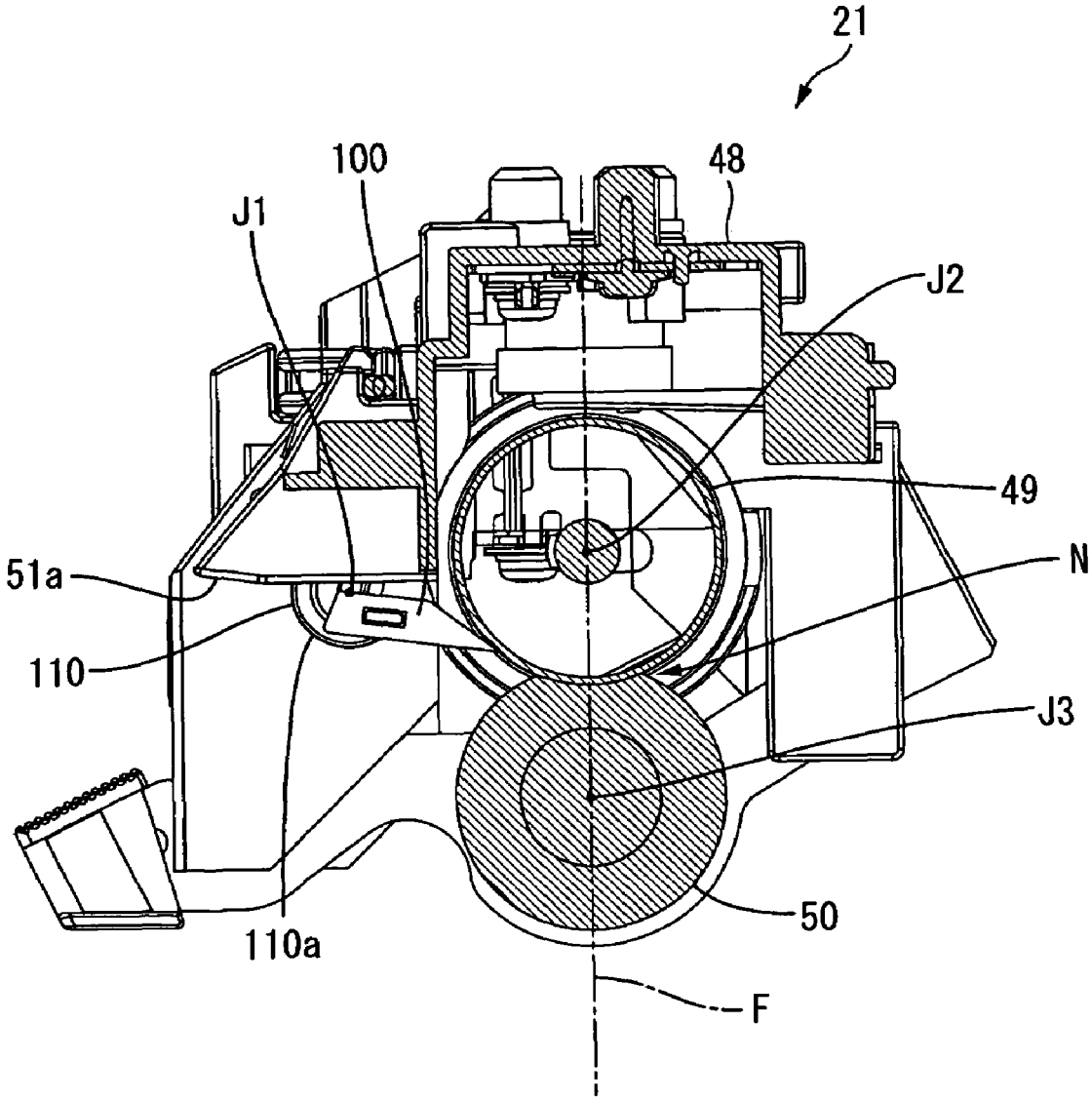
FIG. 4 is a conceptual sectional view taken along line 4-4 in FIG. 2.
Figure 5:
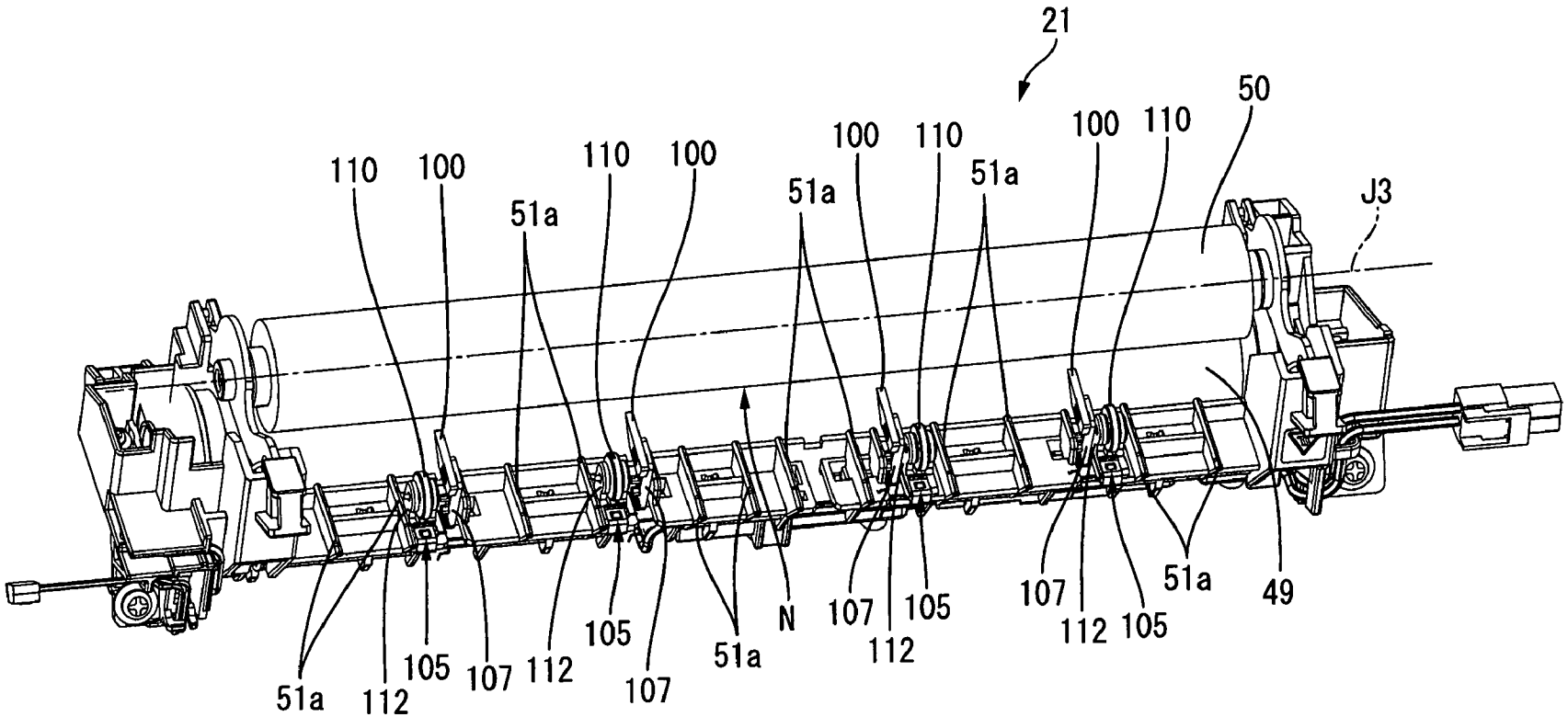
FIG. 5 is a perspective view of an important part of the fuser as viewed obliquely from a bottom-rear position.

Next, the fuser 21 according to this illustrative aspect will be described in a specific manner. FIG. 2 is a view of the fuser 21 as viewed from below in the direction in which the heating roller 49 and the pressing roller 50 (i.e., their rotation axes J2 and J3) are opposed to each other. FIG. 3 is a conceptual sectional view taken along line 3-3 in FIG. 2. FIG. 4 is a conceptual sectional view taken along line 4-4 in FIG. 2. FIG. 1 is a sectional view of the entire image forming apparatus taken along line 4-4 in FIG. 2, and FIG. 4 is an enlarged view of part of FIG. 1. FIG. 5 is a perspective view of an important part of the fuser 21 as viewed obliquely from a bottom-rear position.

As shown in FIG. 1, the fuser 21 is equipped with the heating roller 49 (corresponds to a heating member and a heating roller member) and the pressing roller 50 (corresponds to a pressing member and a pressing roller member) which is pressed against the heating roller 49 and thereby forms a nip position N. The fuser 21 is configured so as to hold and transport a sheet 3 by means of the heating roller 49 and the pressing roller 50 and to thermally fix a developer on the sheet 3 during that course.

The heating roller 49 is equipped with a metal pipe whose surface is coated with a fluororesin and a halogen lamp for heating which is provided in the metal pipe. The heating roller 49 is driven rotationally by motive power supplied from a motor (not shown).

The pressing roller 50 is disposed below the heating roller 49, and is opposed to the heating roller 49 so as to be pressed against it. The pressing roller 50 is configured in such a manner that a metal roller shaft is covered with a roller made of a rubber material. The pressing roller 50 is rotated so as to follow the rotation of the heating roller 49 being driven.

In this illustrative aspect, both of the fixing of a developer and the transport of a sheet can be performed satisfactorily because the fixing is performed by the heating roller 49 and the pressure roller 50. However, on the other hand, a sheet 3 is prone to stick to the heating roller 49. To solve this problem, as shown in FIG. 1, plural (in this illustrative aspect, four) peeling nails 100 for peeling a sheet 3 off the heating roller 49 are disposed downstream of the nip position N of the heating roller 49 and the pressure roller 50 in the sheet transport direction.

As shown in FIGS. 2 and 3, the peeling nails 100 are attached swingably to the fuser frame 48 via support members 107 (in this illustrative aspect, the peeling nails 100 are configured so as to be rotatable about axial lines that are parallel with the width direction of a sheet 3 being transported (i.e., the above-mentioned Z-axis direction, the axial line J3). A tip portion, opposed to the heating roller 49, of each peeling nail 100 is sharpened and is urged toward the outer circumferential surface of the heating roller 49 by an urging means such as a spring. As shown in FIG. 2, each peeling nail 100 assumes a plate-like shape as a whole and is attached to the fuser frame 48 in such a form that its thickness direction is parallel with the width direction of a sheet 3 being transported (i.e., Z-axis direction, axial line J3). As shown in FIG. 3, the tip portion (i.e., the end portion located on the upstream side in the sheet transport direction) of each peeling nail 100 is a peeling portion 101 which operates to peel a head portion of a sheet 3 being transported off the heating roller 49, and the peeling portion 101 of each peeling nail 100 is disposed so as to be opposed to the heating roller 49. The peeling nails 100 according to this illustrative aspect are heat-resistant resin members so as to be resistant to heating by the heating roller 49. More specifically, each peeling nail 100 is formed by applying a surface coating of a PFA resin, a PTFE resin, or the like to a resin base made of polyimide or the like.

Further, as shown in FIG. 3, to prevent an event that a sheet 3 interferes with the peeling nails 100 again after being peeled off the heating roller 49 by the peeling nails 100, the fuser 21 according to this illustrative aspect is equipped with interference prevention rollers 110 (correspond to the terms "interference prevention members," "rotary members," and "roller members" in the claims). The interference prevention rollers 110 are disposed at such positions as to be opposed to a sheet 3 being transported (i.e., the sheet transport path 3') and are supported rotatably, and function to prevent interference between a sheet 3 being transported and downstream end portions 102 (i.e., end portions located on the downstream side in the sheet transport direction) of the peeling nails 100. More specifically, as shown in FIG. 5, each interference prevention roller 110 is supported rotatably with part of a support member 112 (which is a component separate from the peeling nail 100 and the support member 107) as a bearing. The support members 112 are attached to the bottom side of the fuser frame 48. At least the outer circumferential surfaces of the interference prevention rollers 110 according to this illustrative aspect are subjected to fluorine processing. The interference prevention rollers 110 according to this illustrative aspect are made of a different material than the peeling nails 100.

In the configuration according to this illustrative aspect, a sheet 3 can be peeled off the heating roller 49 satisfactorily because as shown in FIG. 3 the upstream end portions of the peeling nails 100 function as the peeling portions 101. However, on the other hand, the downstream end portions 102 are prone to interfere with a sheet 3. This problem is more remarkable when it is attempted to bring the peeling nails 100 (more specifically, peeling portions 101) closer to the nip position N because it causes the entire peeling nails 100 come closer to the sheet transport path 3'. In this illustrative aspect, the interference prevention rollers 110 prevent interference between the downstream end portions 102 and a sheet 3 and thereby enable both of stable peeling and the prevention of interference. Since the interference prevention rollers 110 as the interference prevention members are rotary members, their outer surfaces are moved as a sheet 3 is moved, which produces an effect of reducing friction and impact on the sheet 3. This structure can realize the prevention of interference while making the influences on a sheet 3 smaller than the structure in which the outer surfaces cannot be moved. Further, since the interference prevention rollers 110 are roller members having cylindrical outer surfaces (outer circumferential surfaces 110*a*), the outer surfaces contact a sheet 3 smoothly, which makes the influences of the contact very small.

As shown in FIG. 3, the interference prevention rollers 110 are disposed at such positions as to be closer to a sheet 3 being transported (in other words, closer to the sheet transport path 3') than the downstream end portions 102 of the peeling nails 100 are. That is, the distance L2 between the interference prevention rollers 110 and the sheet transport path 3' is shorter than the distance L1 between the downstream end portions 102 of the peeling nails 100 and the sheet transport path 3'. By virtue of this structure, a sheet 3 is made less prone to contact the downstream end portions 102 of the peeling nails 100 as portions that would otherwise be prone to contact a sheet 3, whereby the interference between the downstream end portions 102 and a sheet 3 can be prevented effectively.

The interference prevention rollers 110 are provided so as to project toward a sheet 3 being transported from the plane of opposed surfaces 103, opposed to the sheet 3 being transported (i.e., the sheet 3 traveling along the sheet transport path 3'), of the peeling nails 100 (i.e., the interference prevention rollers 110 are provided so as to project toward the sheet transport path 3'). Since interference prevention rollers 110 are provided so as to project toward the sheet transport path 3' from the plane of the opposed surfaces 103 of the peeling nails 100, even if a sheet 3 comes closer to the peeling nails 100 after being peeled the projected interference prevention rollers 110 prevent the sheet 3 from coming even closer to the peeling nails 100. Therefore, a sheet 3 is made less prone to contact the peeling nails 100 and interference is prevented satisfactorily.

As shown in FIG. 3, the downstream end portion 102, located on the downstream side in the sheet transport direction, of each peeling nail 100 is provided in an area enclosed by the outer circumferential surface 110*a* of the associated interference prevention roller 110 when projected onto a plane that is perpendicular to a rotation axial line J1 of the interference prevention roller 110 (i.e., the paper surface of FIG. 3). Since almost all of a sheet 3 being transported passes through an area that is outside the area enclosed by the outer circumferential surface 110*a* (i.e., the sheet transport path 3' is formed outside the latter area), the downstream end portions 102 of the peeling nails 100 are protected stably by the outer circumferential surfaces 110*a*. Therefore, a sheet 3 can effectively be prevented from contacting the downstream end portions 102 while smooth sheet transport is realized.

In this illustrative aspect, as shown in FIGS. 2 and 5, plural peeling units 105, which are formed by the peeling nails 100 and the interference prevention rollers 110, are spaced from each other in the direction parallel with the width direction of a sheet 3 being transported (i.e., Z-axis direction, axial line J3). Therefore, a sheet 3 being transported can be peeled off stably over a prescribed area extending in the sheet width direction while interference with each peeling nail 100 can be prevented effectively.

As shown in FIG. 2, in each peeling unit 105, the interference prevention roller 110 is disposed outside the peeling nail 100 in the direction parallel with the sheet width direction (i.e., Z-axis direction, axial line J3). Where the plural peeling nails 100 are arranged in the direction parallel with the width direction (Z-axis direction), a sheet 3 being transported can be peeled off stably over the prescribed area extending in the width direction. However, on the other hand, the peeling effect tends to be relatively small or the degree of peeling tends to be insufficient in regions outside the area where the plural peeling nails 100 are arranged (i.e., regions Q1 and Q2 where none of the peeling nails 100 exist). Influenced by this phenomenon, a sheet 3 is more prone to contact the outside peeling nails 100 than the inside ones in the width direction (Z-axis direction) In contrast, in this illustrative aspect, since the interference prevention roller 110 is disposed outside the peeling nail 100 in each peeling unit 105, the outside portion of each peeling nail 100 to which a sheet 3 tends to come closer is protected with greater care. This relationship (i.e., the interference prevention roller 110 is disposed outside the peeling nail 100 in the direction parallel with the sheet width direction (Z-axis direction, axial line J3)) is also established for the two inside peeling units 105. Since the interference prevention roller 110 is disposed outside the peeling nail 100 in all the four peeling units 105, a sheet 3 can be protected with great care more effectively.

As shown in FIG. 1, in the laser printer 1, the plural sheet ejection guide members 51 for guiding a sheet 3 being transported are disposed downstream, in the sheet transport direction, of the nip position N which is formed by the heating roller 49 and pressing roller 50. More specifically, the plural sheet ejection guide members 51 include a first guide member 51*a*, a second guide member 51*b*, a third guide member 51*c*, and a fourth guide member 51*d*. The first guide member 51*a*, the second guide member 51*b*, the third guide member 51*c*, and the fourth guide member 51*d*, which constitute almost all of the sheet ejection guide members 51, function as a reversing unit 120 for reversing the sheet transport direction from the direction set by the heating roller 49 and the pressing roller 50 (i.e., the rearward direction that is perpendicular to a plane F) to the direction opposite to it.

In this illustrative aspect, since the reversing unit 120 reverses the sheet transport direction from the direction set by the heating roller 49 and the pressing roller 50 to the direction opposite to it, the sheet transport path is made compact and the size of the apparatus is reduced accordingly. However, with the thus-configured reversing unit 120, a sheet 3 behaves so as to come closer to the peeling nails 100, which raises a problem that the sheet 3 becomes more prone to interfere with the peeling nails 100. However, since as described above the interference prevention rollers 110 prevents interference between a sheet 3 and the peeling nails 100, both of the miniaturization of the apparatus and the protection of a sheet 3 can be realized.

A pair of ejection roller members 52 for ejecting a sheet 3 toward the sheet ejection tray 53 (corresponds to a sheet placement unit) are disposed downstream of the nip position N which is formed by the heating roller 49 and the pressing roller 50, and drive power is transmitted from a driving means (motor (not shown)) to one of the pair of ejection roller members 52 via transmission members such as gears. Alternatively, drive power may be transmitted from the driving means to both of the pair of ejection roller members 52.

On the other hand, the sheet transport path (i.e., sheet ejection guide members 51) between the nip position N and the pair of ejection roller members 52 are formed only by non-driven members which receive no drive power from a driving means such as a motor. That is, the guide members 51*a*-51*d* constituting the sheet ejection guide members 51 are non-driven members. That is, no driven-members are provided in the path in which the sheet ejection guide members 51 are disposed, whereby the apparatus configuration is simplified effectively.

<Illustrative Aspect 2>

Figure 6:
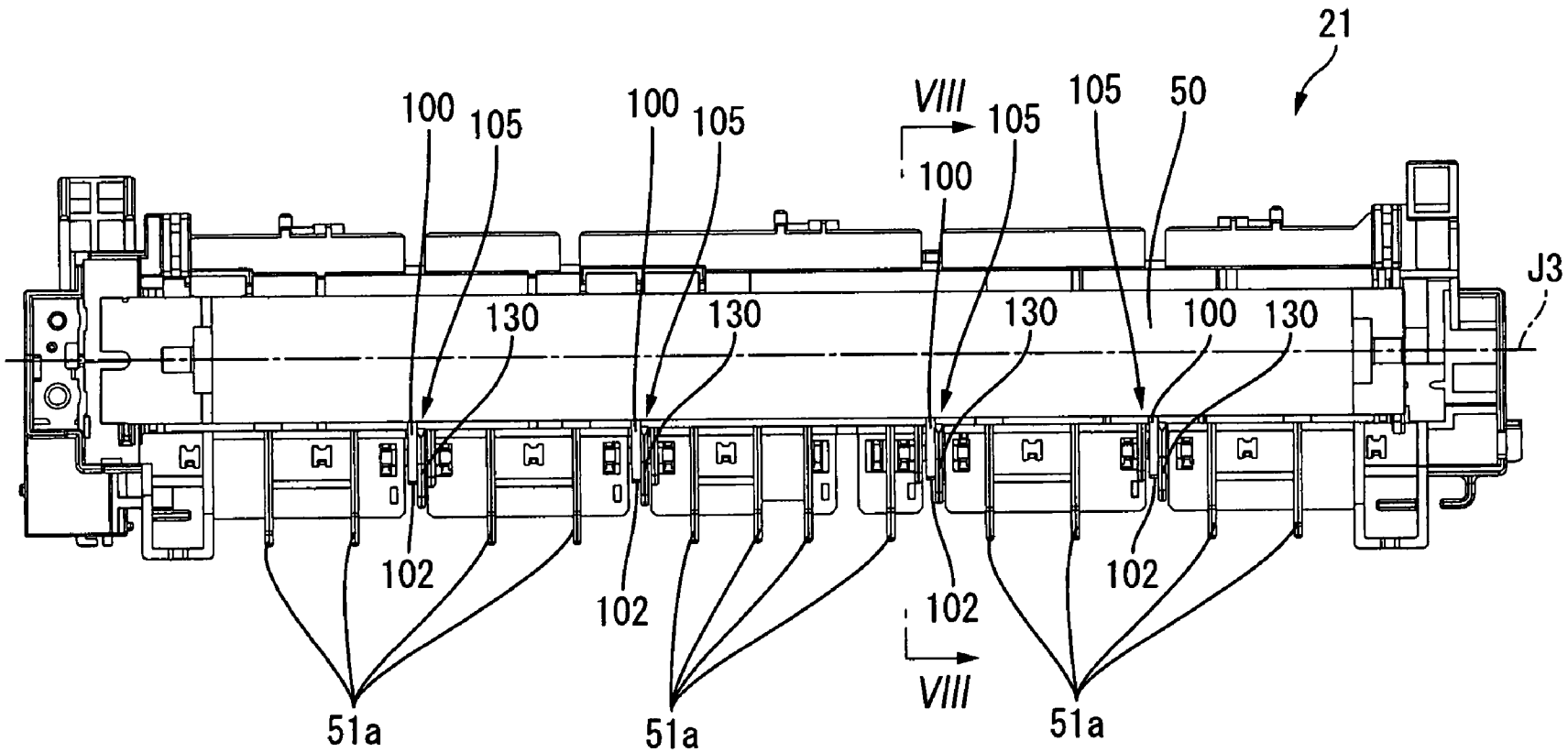
FIG. 6 is a view of an important part of a fuser according to a second aspect as viewed from below in a direction in which a heating roller and a pressing roller are opposed to each other.
Figure 7:
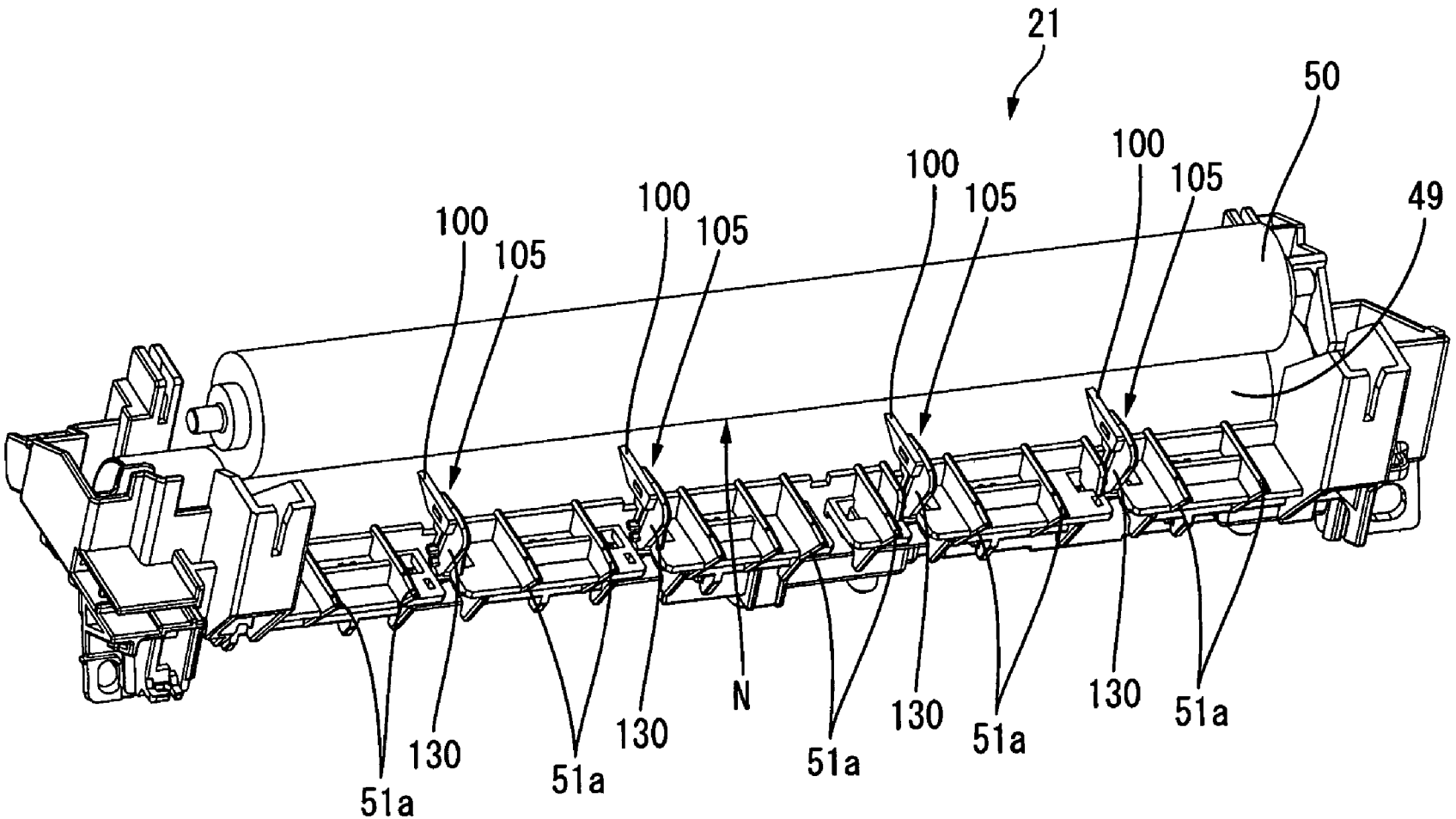
FIG. 7 is a perspective view of an important part of the fuser as viewed obliquely from a bottom-rear position.

Next, a second illustrative aspect of the invention will be described with reference to FIGS. 6-8.

The second illustrative aspect is the same as the first illustrative aspect except for the structure of the interference prevention members. Therefore, the units and components that are the same as in the first illustrative aspect will be given the same reference symbols as given in the first illustrative aspect and will not be described in detail. FIG. 6 is a view of an important part of the fuser as viewed from below in the direction in which the heating roller and the pressing roller are opposed to each other FIG. 7 is a perspective view of an important part of the fuser as viewed obliquely from a bottom-rear position. FIG. 8 is a conceptual sectional view taken along line 8-8 in FIG. 6.

The interference prevention members according to this illustrative aspect are interference prevention ribs 130 which are disposed adjacent to the respective peeling nails 100 and assume a rib-like shape. Also in this illustrative aspect, as shown in FIGS. 6 and 7, plural peeling units 105 which are similar to those in the first illustrative aspect are formed by the peeling nails 100 and the interference prevention ribs 130. The plural peeling units 105 are spaced from each other in the direction parallel with the width direction of a sheet being transported (i.e., Z-axis direction, axial line J3).

Figure 8:
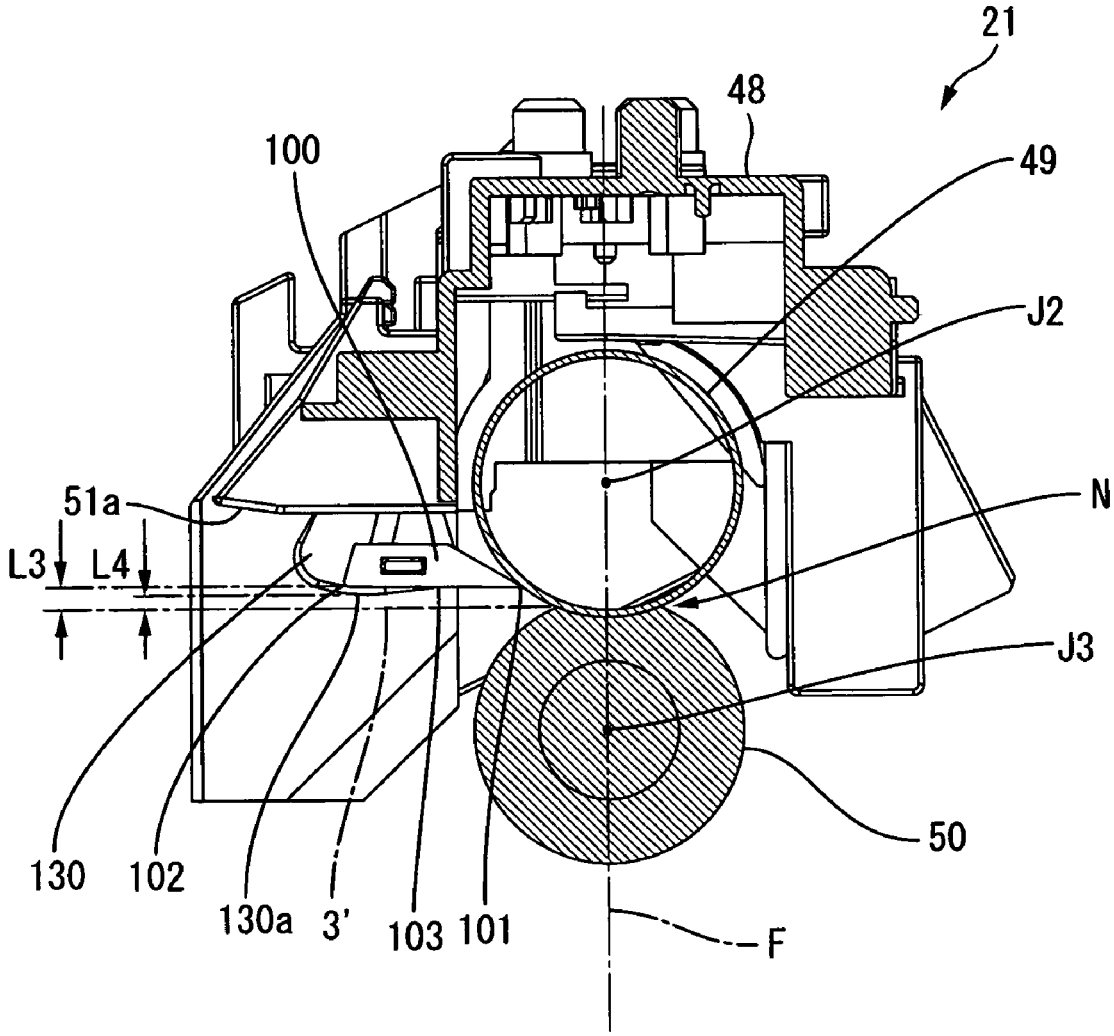
FIG. 8 is a conceptual sectional view taken along line 8-8 in FIG. 6.

As shown in FIG. 8, each of the interference prevention ribs 130 as the interference prevention members has a sheet guide surface 130*a* which is curved so as to be convex toward a sheet 3 being transported in a region opposed to the sheet 3 (i.e., sheet transport path 3'). This structure enables sheet protection though it is simple.

As shown in FIG. 8, the fuser 21 according to this illustrative aspect is provided with the interference prevention ribs 130 (correspond to the term "interference prevention members" in the claims) for preventing a sheet 3 from interfering with the peeling nails 100 again after being peeled off the heating roller 49 by the peeling nails 100. The interference prevention ribs 130 are disposed in the region opposed to a sheet 3 being transported (i.e., the sheet transport path 3') and function to prevent interference between a sheet 3 being transported and the downstream end portions 102, located on the downstream side in the sheet transport direction, of the peeling nails 100. More specifically, as shown in FIG. 7, the interference prevention ribs 130 are components separate from the peeling nails 100 and are attached to the bottom side of the fuser frame 48.

In the configuration according to this illustrative aspect, as shown in FIG. 8, the upstream end portions of the peeling nails 100 function as the peeling portions 101 and, on the other hand, the interference prevention ribs 130 prevent interference between the downstream end portions 102 and a sheet 3, whereby both of stable peeling and the prevention of interference can be realized. More specifically, each downstream end portion 102 is provided in an area enclosed by the sheet guide surface 130*a* when projected onto a plane that is perpendicular to the sheet width direction (i.e., a plane that is perpendicular to the axial lines J2 and J3, the paper surface of FIG. 8). Since the sheet transport path 3' is formed outside this area, a sheet 3 can effectively be prevented from contacting the downstream end portions 102.

As shown in FIG. 8, the interference prevention ribs 130 are disposed at such positions as to be closer to a sheet 3being transported (in other words, closer to the sheet transport path 3') than the downstream end portions 102 of the peeling nails 100 are. That is, the distance L4 between the interference prevention ribs 130 and the sheet transport path 3' is shorter than the distance L3 between the downstream end portions 102 of the peeling nails 100 and the sheet transport path 3'. By virtue of this structure, a sheet 3 is made less prone to contact the downstream end portions 102 of the peeling nails 100 as portions that would otherwise be prone to contact a sheet 3, whereby the interference between the downstream end portions 102 and a sheet 3 can be prevented effectively.

As in the case of the first illustrative aspect, the interference prevention ribs 130 are provided so as to project toward a sheet 3 being transported from the plane of the opposed surfaces 103, opposed to the sheet 3 being transported (i.e., the sheet 3 traveling along the sheet transport path 3'), of the peeling nails 100 (i.e., the interference prevention ribs 130 are provided so as to project toward the sheet transport path 3'). Since interference prevention ribs 130 are provided so as to project toward the sheet transport path 3' from the plane of the opposed surfaces 103 of the peeling nails 100, even if a sheet 3 comes closer to the peeling nails 100 after being peeled the projected interference prevention ribs 130 prevent the sheet 3 from coming even closer to the peeling nails 100. Therefore, a sheet 3 is made less prone to contact the peeling nails 100 and interference is prevented satisfactorily.

<Other Illustrative Aspects>

The invention is not limited to the illustrative aspects that have been described above with reference to the drawings For example, the following illustrative aspects are included in the technical scope of the invention. And various modifications other than the following illustrative aspects are possible without departing from the spirit and scope of the invention.

(1) Although in the above illustrative aspects each combination of an interference prevention member and a peeling member is implemented as a unit, they may be implemented individually.

(2) Although in the above illustrative aspects the heating roller member and the pressing roller member are used as examples of the heating member and the pressing member, respectively, the heating member and the pressing member are not limited these examples as long as they can hold and transport a recording subject medium while heating it.

(3) Although in the above illustrative aspects the peeling nail is used as an example of the peeling member, the peeling member need not be a nail-shaped member as long as it operates to peel a sheet off the heating member.

(4) Although in the above illustrative aspects the interference prevention roller and the interference prevention rib are used as examples of the interference prevention member, the interference prevention member is not limited to these examples as long as it functions to prevent interference between the peeling member and a recording subject medium.

What is claimed is:

1. An image forming apparatus comprising:

a fixing device having a heating member and a pressing member which is pressed against the heating member, the heating member and the pressing member holding and transporting a recording medium to thermally fix a developer on the recording medium;

a peeling member that peels the recording medium off the heating member, the peeling member having an upstream portion and a downstream portion being disposed downstream, in a transport direction of the recording medium, of a holding position where the heating member and the pressing member hold the recording medium; and an interference prevention member that prevents the recording medium from interfering with the peeling member after being peeled off the heating member by the peeling member, and does not apply a transporting force to the recording medium, wherein the interference prevention member overlaps at least the downstream end portion of the peeling member as viewed in a direction perpendicular to the transport direction, is parallel to a plane of the recording medium being transported so that the upstream end portion of the peeling member is contactable with the recording medium, while the downstream portion of the peeling member is prevented from contacting the recording medium, and includes a rotary member supported rotatably and disposed at a position opposed to the recording medium being transported.

2. The image forming apparatus according to claim 1, further comprising: a peeling portion which operates to peel a head portion of the recording medium off the heating member, provided at an upstream end portion of the peeling member in the transport direction of the recording medium so as to be opposed to the heating member; and the interference prevention member prevents the recording medium from interfering with a downstream end portion, located on a downstream side in the transport direction of the recording medium, of the peeling member.

3. The image forming apparatus according to claim 2, wherein the interference prevention member is disposed at a position closer to the recording medium being transported than the downstream end portion of the peeling member.

4. The image forming apparatus according to claim 1, wherein the peeling member has an opposed surface which is opposed to the recording medium being transported; and the interference prevention member projects toward the recording medium from the opposed surface.

5. The image forming apparatus according to claim 1, wherein the downstream end portion, located on the downstream side in the transport direction of the recording medium, of the peeling member is provided in an area enclosed by an outer circumferential surface of the rotary member when projected onto a plane perpendicular to a rotation axial line of the rotary member.

6. The image forming apparatus according to claim 1, wherein the rotary member is a roller member having a cylindrical outer circumferential surface.

7. The image forming apparatus according to claim 1, wherein the interference prevention member has a recording medium guide surface which is curved so as to be convex toward the recording medium being transported in a region opposed to the recording medium being transported.

8. The image forming apparatus according to claim 1, further comprising:

a guide member that guides the recording medium being transported and is disposed downstream of the holding position in the transport direction of the recording medium;

wherein the guide member includes a reversing portion that reverses the transport direction of the recording medium to a direction opposite to a direction in which the recording medium is transported by the heating member and the pressing member.

9. The image forming apparatus according to claim 1, wherein a plurality of peeling units each including the peeling member and the interference prevention member are arranged so as to be spaced from each other in a width direction of the recording medium being transported.

10. The image forming apparatus according to claim 9, wherein in each of the peeling units the interference prevention member is disposed outside the peeling member in the width direction of the recording medium.

11. The image forming apparatus according to claim 1, further comprising:

a recording medium placement unit;

a pair of ejection roller members disposed downstream of the holding position in the transport direction of the recording medium, the pair of ejection rollers ejecting the recording medium toward the recording medium placement unit;

a driving unit that supplies drive power to at least one of the pair of ejection roller members; and a recording medium transport path formed between the holding position and the pair of ejection roller members;

wherein the recording medium transport path does not include a driven member that is supplied with drive power.

12. The image forming apparatus according to claim 1, wherein the peeling member includes a peeling nail having a sharp tip portion which is opposed to the heating member.

13. The image forming apparatus according to claim 1, wherein the heating member includes a heating roller member; and the pressing member includes a pressing roller member which is opposed to an outer circumferential surface of the heating roller member.

14. A fixing device, comprising:

a heating member;

a pressing member which is pressed against the heating member to hold and transport a recording medium therebetween to thermally fix a developer on the recording medium;

a peeling member having an upstream portion and a downstream portion disposed downstream, in a transport direction of the recording medium, of a holding position where the heating member and the pressing member hold the recording medium; and an interference prevention member that prevents the recording medium from interfering with the peeling member, and does not apply a transporting force to the recording medium, wherein the interface prevention member overlaps at least the downstream end portion of the peeling member as viewed in a direction perpendicular to the transport direction, is parallel to a plane of the recording medium being transported so that the upstream end portion of the peeling member is contactable with the recording medium, while the downstream portion of the peeling member is prevented from contacting the recording medium, and includes a rotary member supported rotatably and disposed at a position opposed to the recording medium being transported.

* * * * *